US007215184B2

(12) United States Patent
Aota

(10) Patent No.: US 7,215,184 B2
(45) **Date of Patent: *May 8, 2007**

(54) REFERENCE-VOLTAGE GENERATING CIRCUIT

(75) Inventor: Hideyuki Aota, Hyogo (JP)

(73) Assignee: Ricoh Company, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/354,232

(22) Filed: Feb. 15, 2006

(65) Prior Publication Data

US 2006/0192608 A1 Aug. 31, 2006

Related U.S. Application Data

(63) Continuation of application No. 10/919,256, filed on Aug. 17, 2004, now Pat. No. 7,026,863.

(30) Foreign Application Priority Data

Aug. 26, 2003 (JP) ..... 2003-301693

(51) Int. Cl.
*G05F 1/10* (2006.01)

(52) U.S. Cl. ..... 327/539

(58) Field of Classification Search ..... 327/539; 323/316, 907

See application file for complete search history.

(56) References Cited

U.S. PATENT DOCUMENTS 5,285,069 A 2/1994 Kaibara et al.
5,291,453 A 3/1994 Aota et al.
5,495,444 A 2/1996 Okubo et al.
5,896,515 A 4/1999 Aota et al.
6,150,871 A * 11/2000 Yee ..... 327/538
6,266,762 B1 7/2001 Aota et al.
6,316,915 B1 11/2001 Fujiwara et al.
6,381,491 B1 4/2002 Maile et al.
2003/0214336 A1 11/2003 Watanabe
2004/0004992 A1 1/2004 Aota et al.

FOREIGN PATENT DOCUMENTS

JP 2001-284464 10/2001

* cited by examiner

*Primary Examiner*—Shawn Riley
(74) *Attorney, Agent, or Firm*—Dickstein Shapiro LLP

(57) ABSTRACT

A disclosed reference-voltage generating circuit includes a supply voltage adjusting circuit for adjusting an external supply voltage Vcc and outputting predetermined constant voltages VA and VB; a first voltage supply circuit for generating a voltage Vpn that has a negative temperature coefficient by using the voltage VA; and a second voltage supply circuit for generating a voltage Vptat that has a positive temperature coefficient by using the voltage VB, and for generating the reference voltage Vref, which does not have a temperature coefficient, by adding Vpn and Vptat and thereby canceling the temperature coefficients.

5 Claims, 9 Drawing Sheets

REFERENCE-VOLTAGE GENERATING CIRCUIT

This is a continuation of application Ser. No. 10/919,256, filed on Aug. 17, 2004 now U.S. Pat. No. 7,026,863, the entire disclosure of which is incorporated herein by reference.

BACKGROUND OF THE INVENTION

1. Field of the Invention

The present invention generally relates to a reference-voltage generating circuit, and especially relates to a reference-voltage generating circuit used for a temperature detector and a thermometer.

2. Description of the Related Art

In recent years and continuing, there is a reference-voltage generating circuit that generates a reference voltage by adding a voltage Vptat that has a positive temperature coefficient, and a voltage Vpn that has a negative temperature coefficient using the principle of the work function difference of gates (for example, Patent Reference 1 refers). Such a reference-voltage generating circuit, using the principle of the work function difference of the gates, adds the voltage Vptat that has a positive temperature coefficient and the voltage Vpn that has a negative temperature coefficient for generating a predetermined reference voltage Vref.

FIG. 10 is a circuit diagram showing an example of a conventional reference-voltage generating circuit.

The reference-voltage generating circuit shown by FIG. 10 includes n channel type field-effect transistors (n-type transistors) M1 through M4 wherein concentrations of substrate impurities and channel dopant are equal, and the n-type transistors are formed in a p-well of an n-type substrate. For each of the n-type transistors M1 through M4, a substrate potential and a source potential are made equal to each other. Further, the n-type transistor M1 has a high concentration n-type gate, and the n-type transistor M2 has a high concentration p-type gate. Further, the ratios S of the channel width W to the channel length L (i.e., S=W/L) of the n-type transistors M1 and M2 are set equal to each other.

Further, the n-type transistor M3 has a high concentration n-type gate, and the n-type transistor M4 has a low concentration n-type gate. Further, the ratios S of the channel width W to the channel length L (i.e., S=W/L) of the n-type transistors M3 and M4 are set equal to each other. The n-type transistor M1 serves as a constant-current power supply, and the same current flows through the n-type transistors M1 and M2. Accordingly, voltages V1 and V2 (refer to FIG. 10) are expressed as follows, where Vpn represents a voltage between the source and the gate of the n-type transistor M2, and R1 and R2 represent the resistance values of resistors R1 and R2, respectively.

$$V1=Vpn$$

$$V2=R2\times Vpn/(R1+R2)$$

Further, since the n-type transistor M4 serves as a constant-current power supply, the same current flows through the n-type transistors M3 and M4, gates of which have different impurity concentrations, and the voltage between the source and the gate of the n-type transistor M3 becomes −Vptat. Given that the voltage V2 is applied to the gate of the n-type transistor M3, the source voltage V3 of the n-type transistor M3 is expressed as follows.

$$V3 = V2 - (-Vptat)$$

$$= R2 \times Vpn/(R1 + R2) + Vptat( = Vref)$$

FIG. 11 shows an example of the Vg-Id characteristics of the gate voltage Vg vs. the drain current Id of the n-type transistors M1 through M4. As for the n-type transistor M1, the gate is connected to the source, and a drain current Id1 flows. The same current Id1 flows through the n-type transistor M2 that is connected in series with the n-type transistor M1. Accordingly, the voltage Vpn is equal to the voltage difference between the gate voltage Vg of the n-type transistor M1 and the gate voltage Vg of the n-type transistor M2. Further, as for the n-type transistor M4, wherein the gate is connected to the source, a drain current Id4 flows. Since the n-type transistor M3 is connected in series with the n-type transistor M4, the same current Id4 flows through the transistor M3. Accordingly, the voltage difference between the gate voltage Vg of the n-type transistor M3 and the gate voltage Vg of the n-type transistor M4 is equal to the voltage Vptat. The sum of the voltage Vpn and the voltage Vptat serves as the reference voltage Vref.

On the other hand, voltages Vds1 through Vds4 between the drains and the sources of the n-type transistors M1 through M4, respectively, are expressed as follows, given that the voltage of the point connecting the n-type transistors M1 and M2 is equal to V1+Vgs5, where Vgs5 represents the voltage between the gate and the source of an n-type transistor M5, and the voltage of the point connecting the n-type transistors M3 and M4 is V3.

$$Vds1=Vcc-(V1+Vgs5)=Vcc-(Vpn+Vgs5)$$

$$Vds2=V1+Vgs5=Vpn+Vgs5$$

$$Vds3=Vcc-V3=Vcc-Vref$$

$$Vds4=V3=Vref$$

[Patent reference 1]
JPA, 2001-284464

DESCRIPTION OF THE INVENTION

[Problem(s) to be Solved by the Invention]

If the voltage Vpn or the reference voltage Vref is stably generated, and if the circuit is carrying out normal operations, the voltage Vgs5 will also be stable, and the voltage values Vds2 and Vds4 are stable. However, when the supply voltage Vcc fluctuates, the voltages Vds1 and Vds3 also fluctuate.

As shown in FIG. 11, when the supply voltage Vcc goes higher, the Vd-Id characteristics of the n-type transistors M1 and M3 indicated by the solid line shift upward as indicated by the dotted line. This causes the voltage Vpn and the voltage Vptat to rise by ΔVpn and ΔVptat, respectively, which in turn causes the reference voltage Vref to rise.

SUMMARY OF THE INVENTION

It is a general object of the present invention to provide a reference-voltage generating circuit that substantially obviates one or more of the problems caused by the limitations and disadvantages of the related art.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a reference-voltage generating circuit particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a reference-voltage generating circuit that is capable of providing a stable reference voltage even when there are power supply fluctuations and individual component characteristic distributions due to manufacturing processes as follows.

The reference-voltage generating circuit according to the present invention includes a supply voltage adjusting circuit for providing a predetermined constant voltage from an externally provided supply voltage, a first voltage supply circuit for generating and outputting a voltage Vpn that has a negative temperature coefficient from the predetermined constant voltage, and a second voltage supply circuit for generating a voltage Vptat that has a positive temperature coefficient from the predetermined constant voltage, and generating the reference voltage Vref by adding the voltage Vptat and the voltage Vpn.

A variation to what is described above is to provide separate predetermined constant voltages, namely, a voltage VA that is supplied to the first voltage supply circuit, and a voltage VB that is supplied to the second voltage supply circuit.

By adding the voltages Vpn and Vptat, the negative temperature coefficient of Vpn and the positive temperature coefficient-of Vptat are cancelled out, and the reference voltage Vref is stably obtained.

DESCRIPTION OF THE PREFERRED EMBODIMENTS

In the following, embodiments of the present invention are described with reference to the accompanying drawings.

The First Embodiment

Figure 1:
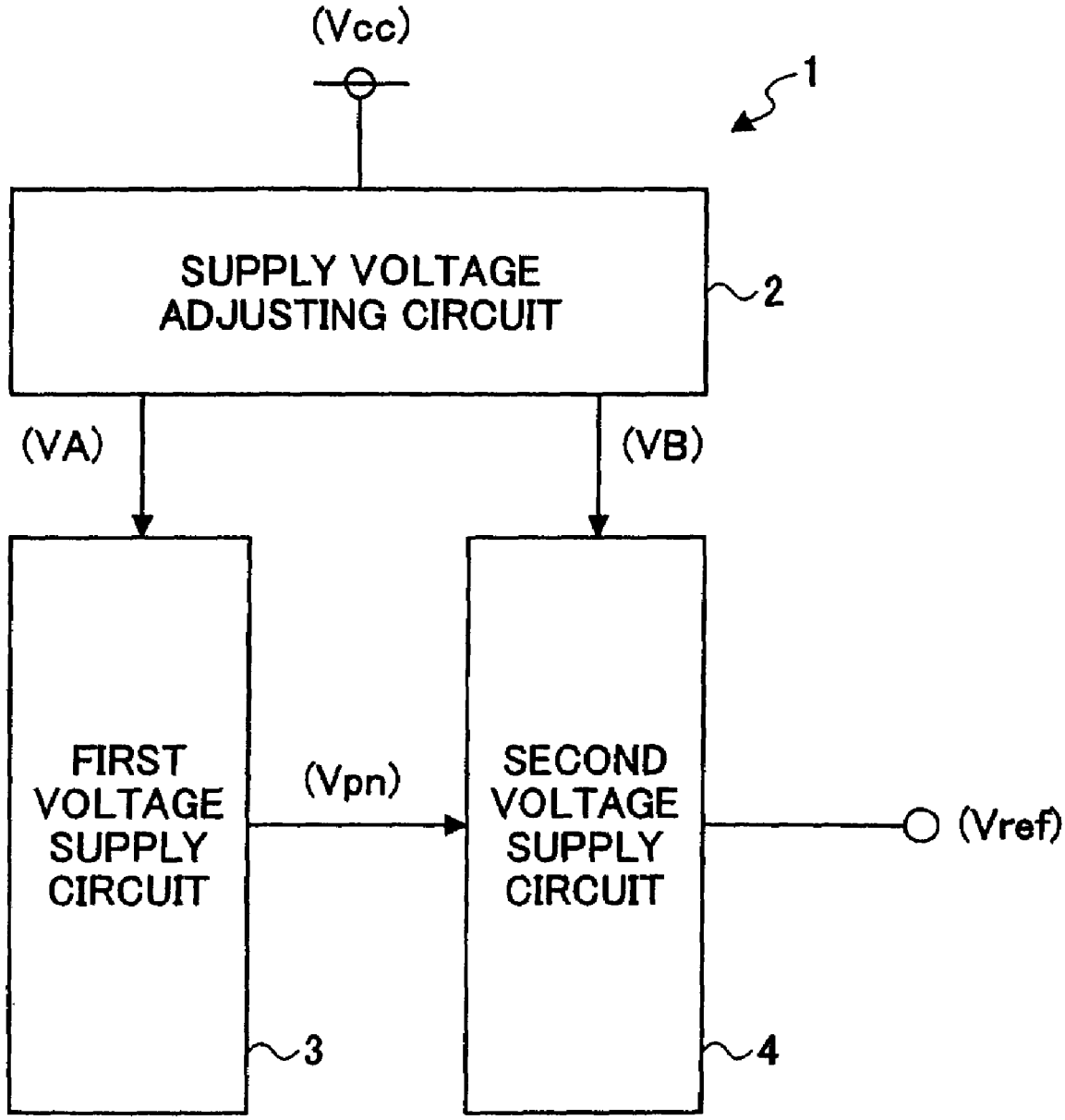
FIG. 1 is a block diagram showing a configuration example of a reference-voltage generating circuit according to the first embodiment of the present invention.

FIG. 1 is a block diagram showing a configuration example of a reference-voltage generating circuit 1 according to the first embodiment of the present invention.

As shown in FIG. 1, the reference-voltage generating circuit 1 includes a supply voltage adjusting circuit 2, a first voltage supply circuit 3, and a second voltage supply circuit 4. In addition, the supply voltage adjusting circuit 2 serves as a supply voltage adjusting unit, the first voltage supply circuit 3 serves as a first voltage supply unit, and the second voltage supply circuit 4 serves as a second voltage supply unit. Further, the supply voltage adjusting circuit 2, the first voltage supply circuit 3, and the second voltage supply circuit 4 may be integrated into an IC.

The supply voltage adjusting circuit 2 adjusts a supply voltage Vcc supplied by an external source to predetermined voltages VA and VB, and outputs the voltages VA and VB. The first voltage supply circuit 3 generates a voltage Vpn, serving as a first output voltage, that has a negative temperature coefficient from the voltage VA, serving as a first predetermined constant voltage. The second voltage supply circuit 4 generates a voltage Vptat, serving as a second output voltage, that has a positive temperature coefficient from the voltage VB, serving as a second predetermined constant voltage, and adds the voltage Vpn having the negative temperature coefficient and the voltage Vptat having the positive temperature coefficients such that the two temperature coefficients cancel each other, thereby generating a reference voltage Vref that does not have a temperature coefficient, and outputs the reference voltage Vref.

Figure 2:
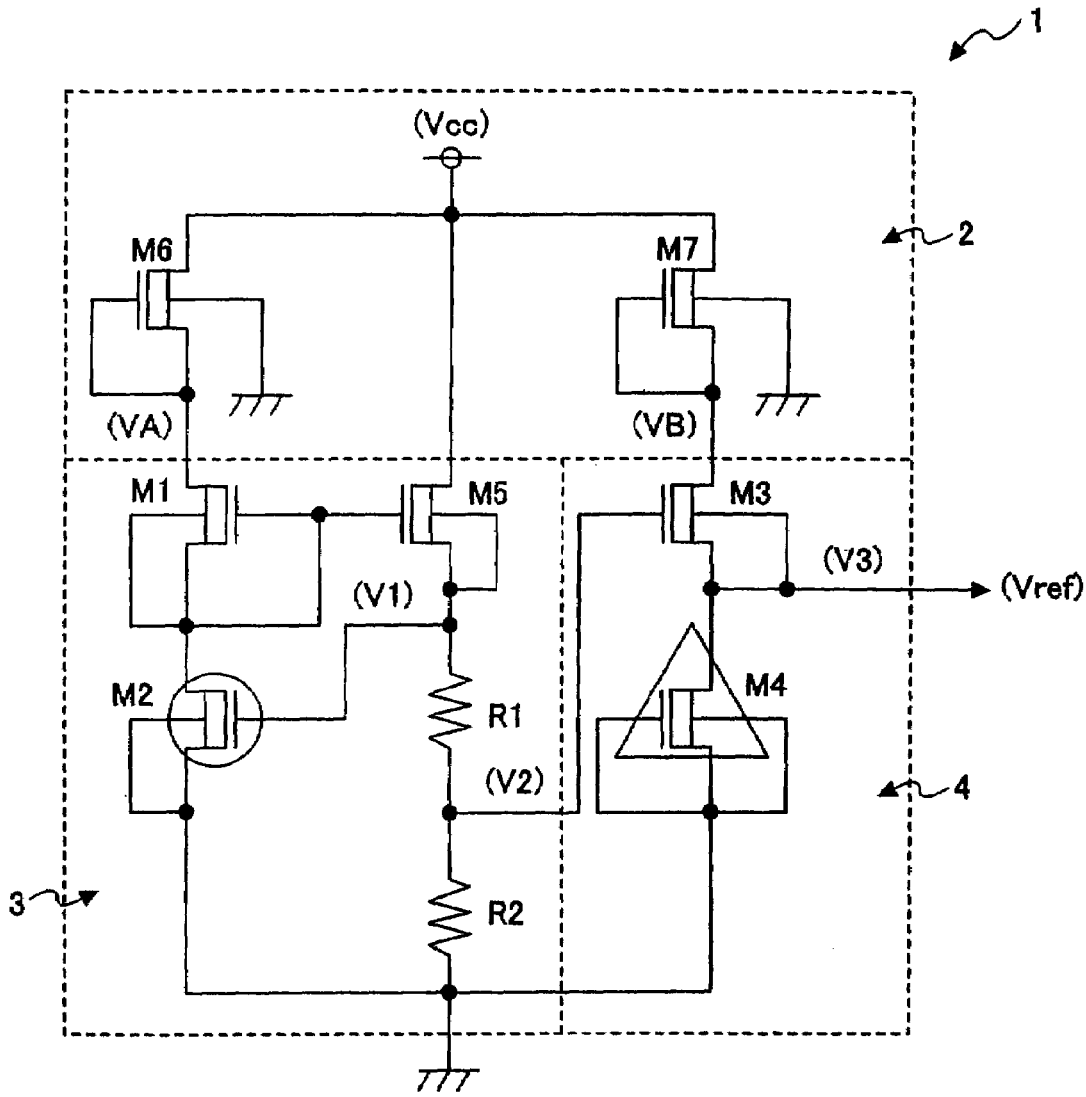
FIG. 2 is a circuit diagram showing an example of an internal circuit of the reference-voltage generating circuit of FIG. 1.

FIG. 2 shows an example of the internal circuit of the reference-voltage generating circuit 1. According to the example shown by FIG. 2, the first voltage supply circuit 3 generates and outputs a voltage V2, serving as a divided voltage, that is proportional to the voltage Vpn. The second voltage supply circuit 4 generates the voltage Vptat, to which the voltage V2 provided by the first voltage supply unit 3 is added to obtain the reference voltage Vref that does not have a temperature coefficient, and outputs the reference-voltage Vref. According to the example of the internal circuit shown by FIG. 2, the supply voltage adjusting circuit 2 includes n channel type field-effect transistors (n-type transistors) M6 and M7; the first voltage supply circuit 3 includes n-type transistors M1, M2, and M5 and resistors R1 and R2; and the second voltage supply circuit 4 includes n-type transistors M3 and M4.

Here, the n-type transistor M1 serves as a third field-effect transistor, the n-type transistor M2 serves as a fourth field-effect transistor, and the n-type transistor M5 serves as a fifth field-effect transistor. Further, the resistors R1 and R2 serve as a voltage dividing circuit. Further, the n-type transistor M3 serves as a sixth field-effect transistor, the n-type transistor M4 serves as a seventh field-effect transistor, the n-type transistor M6 serves as a first field-effect transistor, and the n-type transistor M7 serves as a second field-effect transistor.

The n-type transistors M1 through M4 are formed in the p-well of an n-type substrate, have the same concentrations of substrate impurities and the channel dopant, and the substrate potential of each of the n-type transistors M1 through M4 is equal to the respective source potential. Further, the n-type transistor M1 has a high concentration n-type gate, and the n-type transistor M2 has a high concentration p-type gate. The n-type transistors M1 and M2 have the same ratio S of the channel width W to the channel length L, i.e., S=W/L. Further, the n-type transistor M3 has a high concentration n-type gate, and the n-type transistor M4 has a low concentration n-type gate. The n-type transistors M3 and M4 have the same ratio S of the channel width W to the channel length L, i.e., S=W/L.

Between the supply voltage Vcc and the ground potential, the n-type transistor M5 and the resistors R1 and R2 are connected in series. The voltage V1 at the connecting point of the n-type transistor M5 and the resistor R1 is divided by the resistors R1 and R2, the divided voltage being called the voltage V2. The gate of the n-type transistor M5 and the gate of the n-type transistor M1 are connected. The voltage V1 is supplied to the gate of the n-type transistor M2. The gate and the source of the n-type transistor M1 are connected, serving as a constant current source. Further, the n-type transistors M1 and M2 are connected in series between the voltage VA and the ground potential, and the same current flows through the n-type transistors M1 and M2 that have different electric conduction types from each other.

Further, the voltage V2 is supplied to the gate of the n-type transistor M3. The gate and the source of the n-type transistor M4 are connected, serving as a constant current source. Between the voltage VB and the ground potential, the n-type transistors M3 and M4 are connected in series, and the same current flows through the n-type transistors M3 and M4 that are of the same conduction type, but have the different gate impurity concentrations.

Next, in the supply voltage adjusting circuit 2, the n-type transistors M6 and M7 are depletion-type transistors formed in the p-well of an n-type substrate, each with its gate and source being connected, and each with a substrate gate being connected to the ground potential. Further, the source of the n-type transistor M6 is connected to the drain of the n-type transistor M1, and the source of the n-type transistor M7 is connected to the drain of the n-type transistor M3. The drains of the n-type transistors M6 and M7 are connected to the supply voltage Vcc.

In the configuration as described above, since the gate and the source of the n-type transistor M1 are connected, serving as the constant current source, and the n-type transistors M1 and M2 are connected in series, the same current flows through the n-type transistors M1 and M2 that are of the different conduction types. Accordingly, when the voltage between the source and the gate of the n-type transistor M2 is made into Vpn, and R1 and R2 represent the resistance of the resistors R1 and R2, respectively, the following formulas are obtained.

V1=Vpn $$V2=R2\times Vpn/(R1+R2)$$

Further, the gate and the source of the n-type transistor M4 are connected, serving as a constant current source. The n-type transistors M3 and M4 are connected in series, and the same current flows through the n-type transistors M3 and M4 that have different gate impurity concentrations, but have the same conduction type. Accordingly, the voltage between the source and the gate of the n-type transistor M3 is made into −Vptat. Since the voltage V2 is provided to the gate of the n-type transistor M3, a source voltage V3 of the n-type transistor M3 is expressed as the formula that follows.

$$\begin{aligned} V3 &= V2-(-Vptat) \\ &= R2\times Vpn/(R1+R2)+Vptat \\ &= Vref \end{aligned}$$

Figure 3:
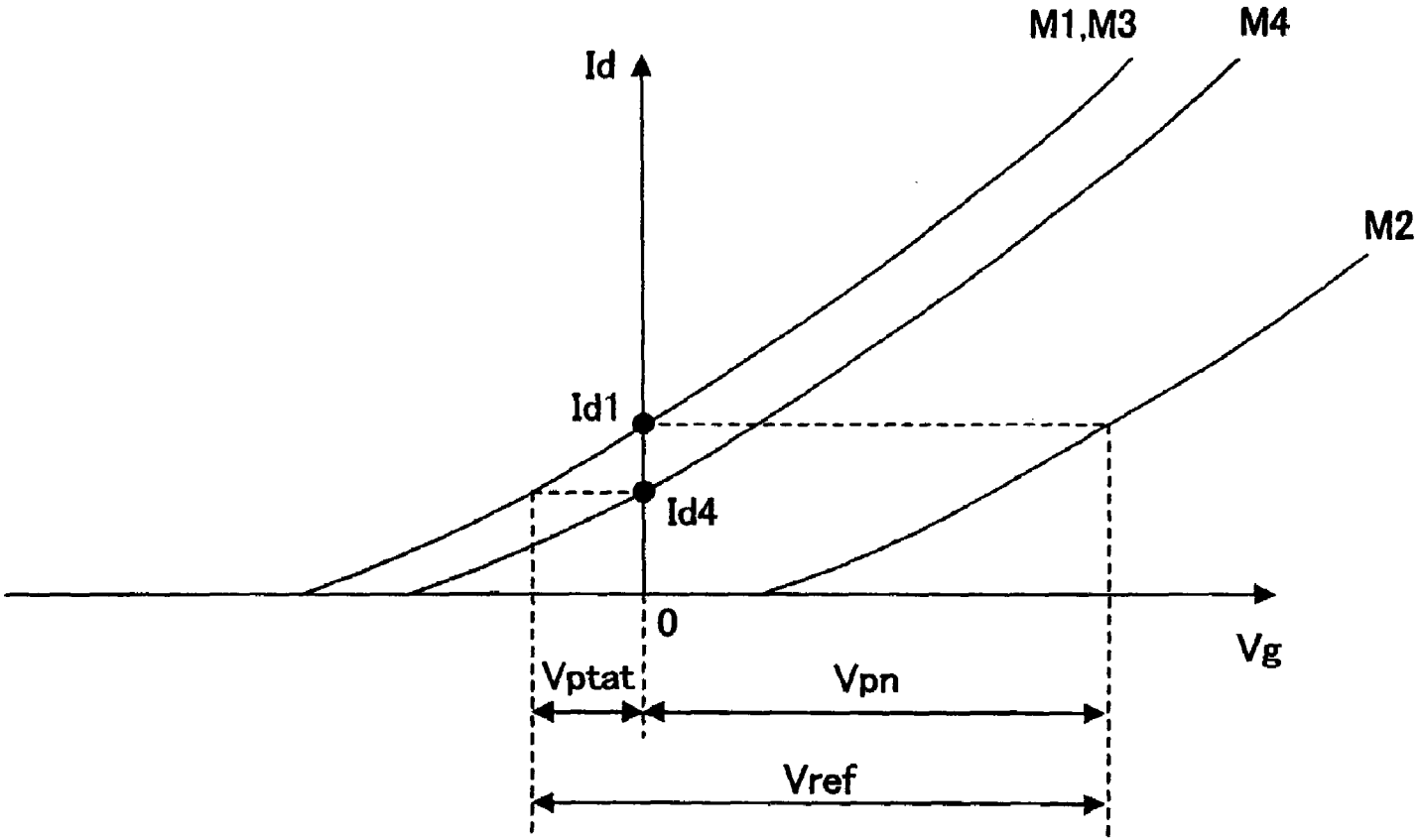
FIG. 3 is a graph showing an example of Vg-Id characteristics of n-type transistors M1 through M4 shown in FIG. 2.

FIG. 3 shows Vg-Id characteristics of the gate voltage Vg vs. drain current Id of the n-type transistors M1 through M4. Since the gate and the source of the n-type transistor M1 are connected, a drain current Id1 flows through the n-type transistor M1. The same current Id1 flows through the n-type transistor M2 that is connected in series with the n-type transistor M1. Accordingly, the voltage difference between the gate voltage Vg of the n-type transistor M1 and the gate voltage Vg of the M2 serves as the voltage Vpn. Further, since the gate and the source of the n-type transistor M4 are connected, the drain current Id4 flows through the n-type transistor M4. Since the n-type transistor M3 is connected in series with the n-type transistor M4, the same current Id4 flows through the n-type transistor 4. Accordingly, the voltage difference between the gate voltage Vg of the n-type transistor M3 and the gate voltage Vg of the n-type transistor M4 serves as the voltage Vptat. The sum of the voltage V2 and the voltage Vptat becomes the reference voltage Vref.

If the concentrations of substrate impurities and channel dopant vary with production processes, concentrations of each transistor similarly vary. Such variations cause the Vd-Id characteristics of the drain voltage Vd vs. drain current Id of the n-type transistors M1 through M4 to shift right and left, nevertheless maintaining the relations shown in FIG. 3. Further, the shift hardly affects the absolute values of the voltage Vpn and the voltage Vptat, i.e., the reference-voltage Vref can be stably generated.

Further, voltages Vds1 through Vds4 between the drains and the sources of the n-type transistors M1 through M4, respectively, are expressed by the following formulas, wherein (V1+Vgs5) is equal to the voltage of the connecting point of the n-type transistors M1 and M2, and the voltage V3 is equal to the voltage of the connecting point of the n-type transistors M3 and M4.

$$Vds1=Vcc-(V1+Vgs5)=Vcc-(Vpn+Vgs5)$$

$$Vds2=V1+Vgs5=Vpn+Vgs5$$

$$Vds3=Vcc-V3=Vcc-Vref$$

$$Vds4=V3=\mathrm{Vref}$$

Figure 4:
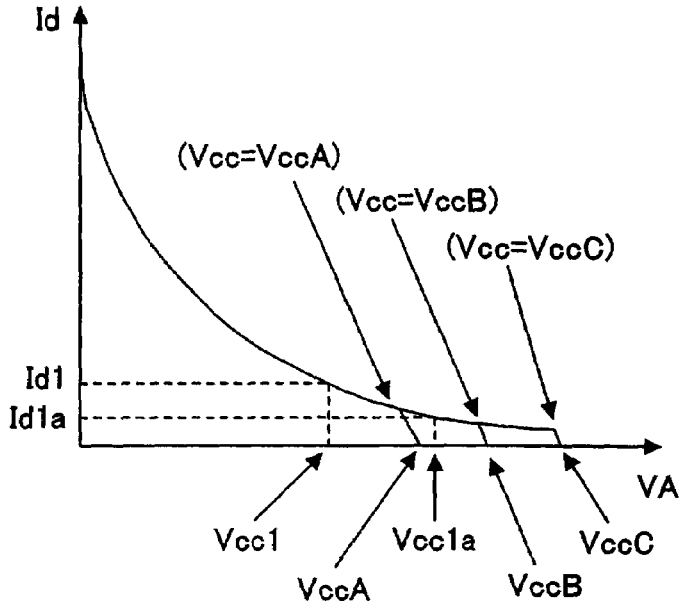
FIG. 4 is a graph showing an example of VA-Id characteristics of an n-type transistor M6 shown in FIG. 2.

Next, FIG. 4 shows an example of the VA-Id characteristics of the drain current Id vs. the voltage VA of the n-type transistor M6.

Here, changes of the drain current Id flowing through the n-type transistor M6 when the voltage VA is increased by raising the supply voltage Vcc from a voltage VccA, to a voltage VccB, and to a voltage VccC are shown. For example, in the case of Vcc=VccA, if the voltage VA approaches the voltage VccA, the drain current Id rapidly decreases, and becomes 0 at VA=VccA. As shown by FIG. 3, since the current Id1 flows through the n-type transistor M1, serving as the constant current source, the current Id1 also flows through the n-type transistor M6.

Figure 5:
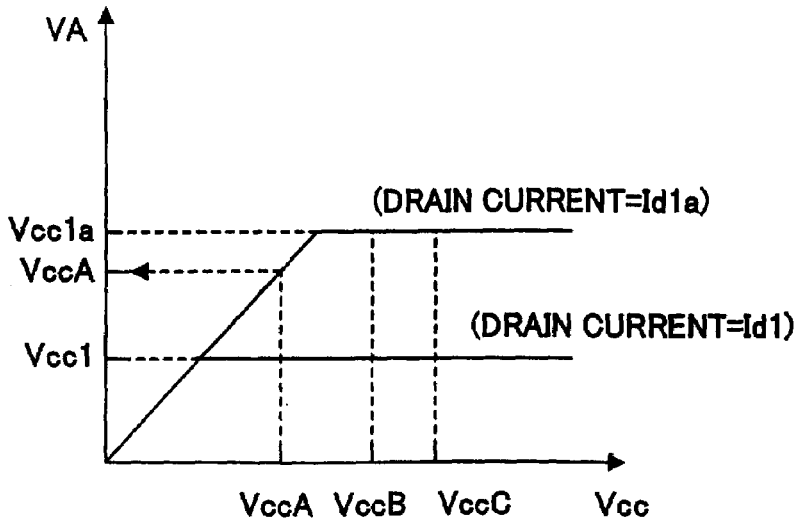
FIG. 5 is a graph showing an example of characteristics of a supply voltage Vcc and a voltage VA.

As described above, the voltage VA is fixed to a voltage Vcc1 regardless of the supply voltage Vcc. However, the voltage VA becomes Vcc1*a* when the current Id1 is too small at a current value Id1*a*. Accordingly, the voltage VA is fixed to Vcc1*a* when Vcc1*a*<VccB where Vcc=VccB, and when Vcc1*a*<VccC where Vcc=VccC. However, when Vcc1*a*>VccA where Vcc=VccA, the voltage VA reaches only the voltage VccA. These matters are shown in FIG. 5.

When the drain current is set at Id1, the voltage VA becomes fixed at the voltage Vcc1 even if Vcc=VccA. In contrast, when the drain current is small at Id1*a*, unless the supply voltage Vcc is greater than the voltage VccB, a fixed voltage at Vcc1*a* is not available. Therefore, the required drain current or the voltage value Vcc1 has to be determined according to the minimum operating voltage of the circuit. Such value can be easily acquired by adjusting one of the channel width W and the channel length L of the n-type transistor M6.

Figure 6:
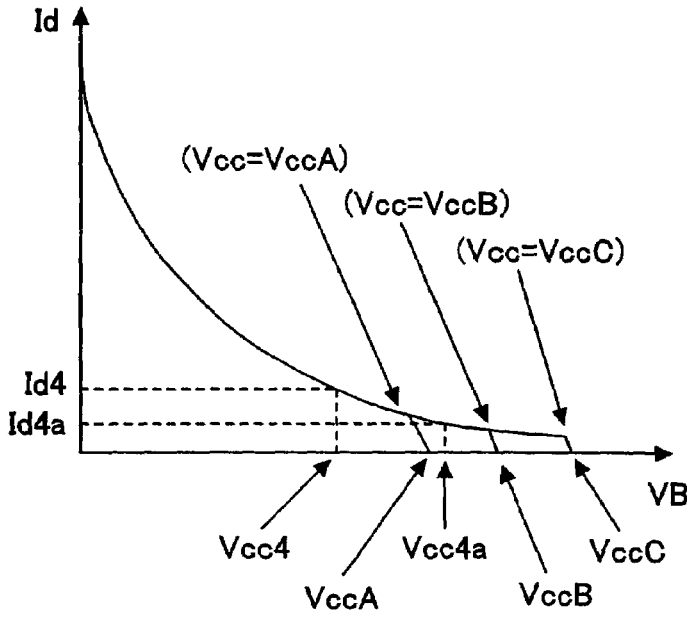
FIG. 6 is a graph showing an example of VB-Id characteristics of an n-type transistor M7 shown in FIG. 2.

Next, FIG. 6 shows an example of the VB-Id characteristics of the voltage VB vs. the drain current Id of the n-type transistor M7. FIG. 6 shows changes in the drain current flowing through the n-type transistor M7 when the voltage VB is raised by raising the supply voltage Vcc from VccA, to VccB, and to VccC. For example, if the voltage VB approaches the voltage VccA when Vcc=VccA, the drain current Id rapidly decreases, and becomes 0 at VB=VccA. As shown in FIG. 3, since the current Id4 flows through the n-type transistor M4, serving as the constant current source, the same current Id4 flows through the n-type transistor M7.

Figure 7:
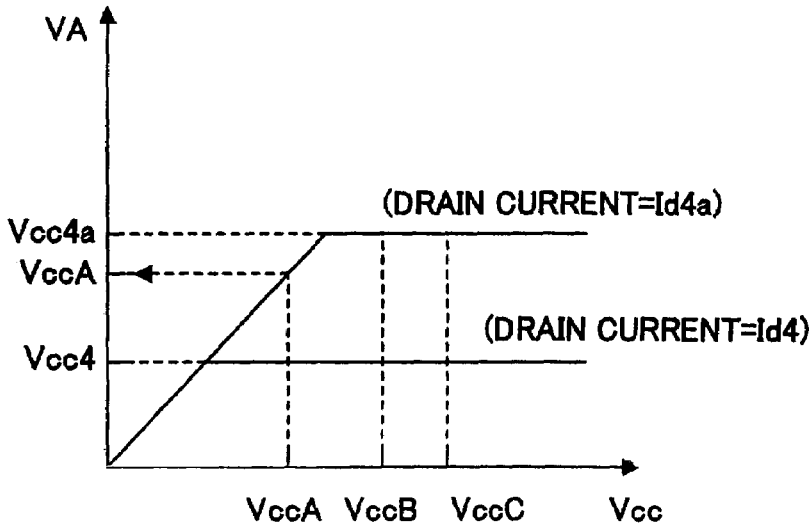
FIG. 7 is a graph showing an example of characteristics of the supply voltage Vcc and a voltage VB.

Therefore, the voltage VB is fixed to the voltage Vcc4 regardless of the supply voltage Vcc. However, when the current value is too small at Id4*a*, the voltage VB becomes Vcc4*a*. Accordingly, the voltage value of voltage VB is fixed to Vcc4*a*, when Vcc4*a*<VccB where Vcc=VccB, and when Vcc4*a*<VccC where Vcc=VccC. However, when Vcc4*a*>VccA where Vcc=VccA, the voltage VB reaches only the voltage VccA. These matters are shown in FIG. 7.

Although the voltage VB becomes fixed at the voltage Vcc4 even in the case of Vcc=VccA when the drain current is Id4, the voltage VB is not fixed at a voltage Vcc4*a* when the drain current is low at Id4*a*, unless the supply voltage Vcc is greater than the voltage VccB. Therefore, the required drain current or the voltage value Vcc4 has to be determined according to the minimum operating voltage of the circuit. Such value can be easily acquired by adjusting one of the channel width W and the channel length L of the n-type transistor M7.

As described above, even if the supply voltage Vcc fluctuates, the voltages VA and VB are fixed to the voltages Vcc1 and Vcc4, respectively, by providing the n-type transistors M6 and M7 in this manner. Accordingly, the voltage Vds of each transistor is expressed as follows, given that the voltage between n-type transistors M1 and M2 is (V1+Vgs5), and the voltage between the n-type transistors M3 and M4 is V3.

$$\mathrm{Vds}1=VA-(V1+Vgs5)=Vcc1-(Vpn+Vgs5)$$

$$Vds2=V1+Vgs5=Vpn+Vgs5$$

$$Vds3=VB-V3=Vcc4-Vref$$

$$Vds4=V3=Vfef$$

In this manner, even if the supply voltage Vcc fluctuates, the voltages Vpn, Vref, and Vgs are stably generated at fixed values with the voltages Vcc1 and Vcc4 being constant, and the voltages Vds1 through Vds4 between the drain and the sources of the n-type transistors M1 through M4, respectively, being unaffected by the supply voltage Vcc fluctuation. Therefore, there are no gaps (shifts) of the Vg-Id characteristics due to the supply voltage Vcc fluctuation, keeping the reference-voltage Vref at a constant level. Further, since the principle of the work function difference of the gate is applied, variations in the reference-voltage Vref due to manufacturing processes are eliminated.

The Second Embodiment

According to the first embodiment of the present invention, the supply voltage adjusting circuit 2 consists of two n-type transistors, namely, the n-type transistors M6 and M7. The second embodiment is characterized by the supply voltage adjusting circuit 2*a* being constituted by one n-type transistor, namely M6.

Figure 8:
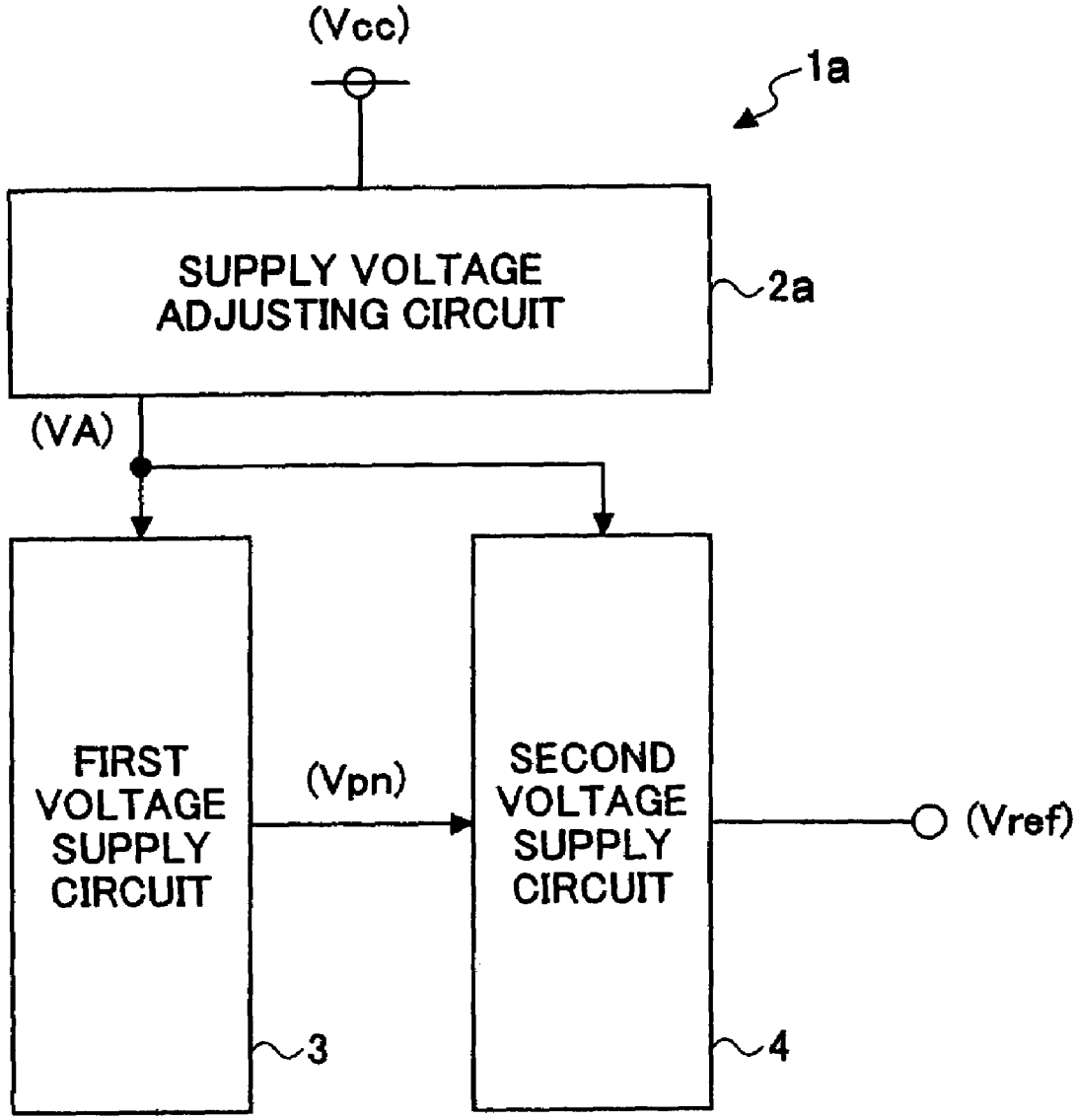
FIG. 8 is a block diagram showing a configuration example of the reference-voltage generating circuit according to the second embodiment of the present invention.

FIG. 8 is a block diagram showing a configuration example of a reference-voltage generating circuit 1*a* according to the second embodiment of the present invention. Here in FIG. 8, the same reference marks designate the same elements as FIG. 1, and explanations thereof are not repeated. In the following, differences of the second embodiment from the first embodiment are described.

The differences between FIG. 1 and FIG. 8 include that the supply voltage adjusting circuit 2 of FIG. 1 provides the voltages VA and VB, while the supply voltage adjusting circuit 2*a* of FIG. 8 provides only the voltage VA, which voltage is used by the first and the second voltage supply circuits 3 and 4.

The reference-voltage generating circuit 1*a* includes the supply voltage adjusting circuit 2*a*, the first voltage supply circuit 3, and the second voltage supply circuit 4. Here, the supply voltage adjusting circuit 2*a*, the first voltage supply circuit 3, and the second voltage supply circuit 3 may be integrated into an IC.

The supply voltage adjusting circuit 2*a* receives the supply voltage Vcc from an external source, and outputs the voltage VA. The first voltage supply circuit 3 generates and outputs the voltage Vpn that has a negative temperature coefficient by using the voltage VA. The second voltage supply circuit 4 generates the voltage Vptat that has a positive temperature coefficient by using the voltage VA, and generates and outputs the reference voltage Vref by adding the voltages Vpn and Vptat. Accordingly, the reference voltage Vref does not have a temperature coefficient since the negative temperature coefficient of the voltage Vpn is canceled by the positive temperature coefficient of the generated voltage Vptat.

Figure 9:
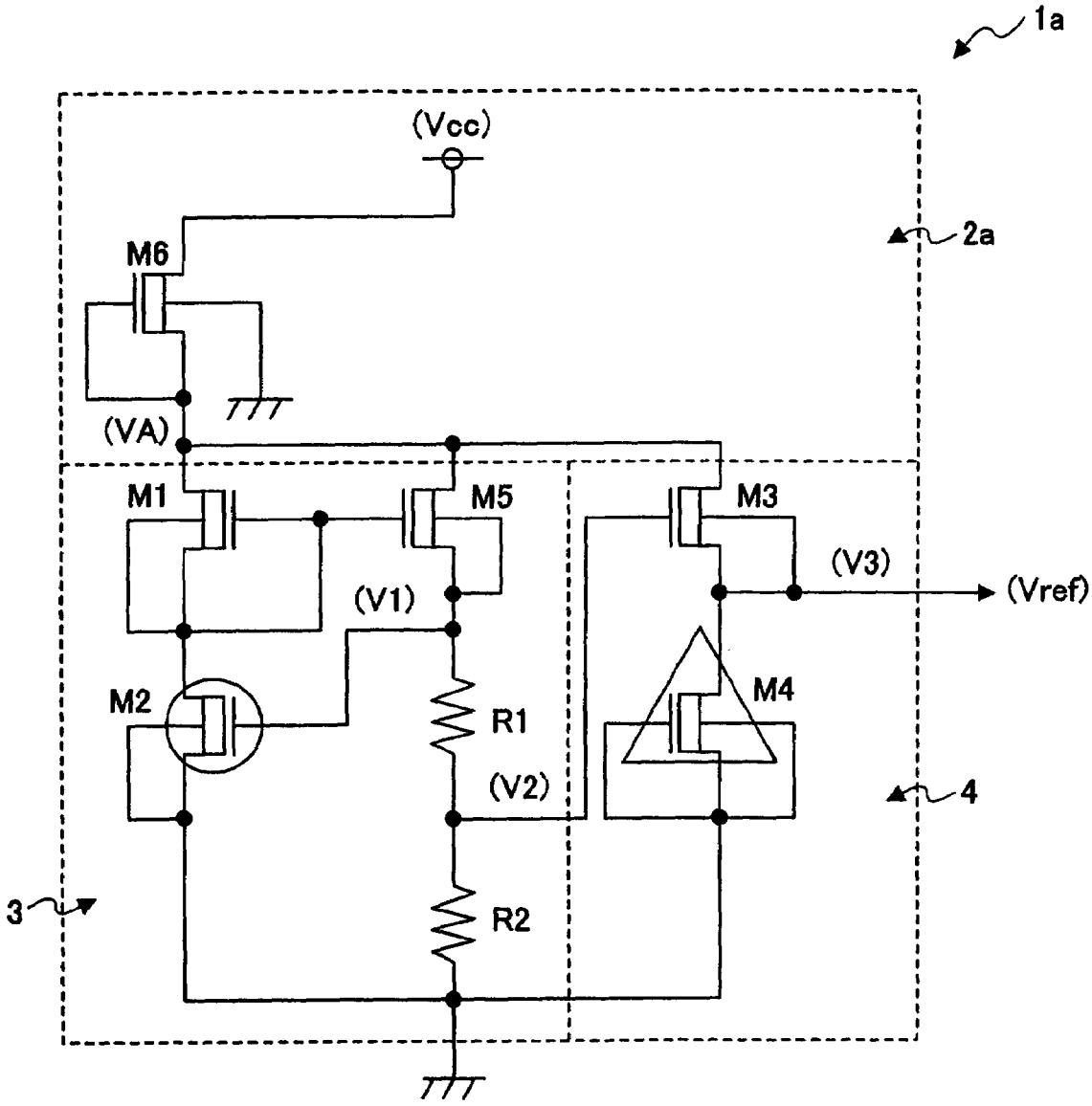
FIG. 9 is a circuit diagram showing an example of the internal circuit of the reference-voltage generating circuit according to the second embodiment of the present invention.
Figure 10:
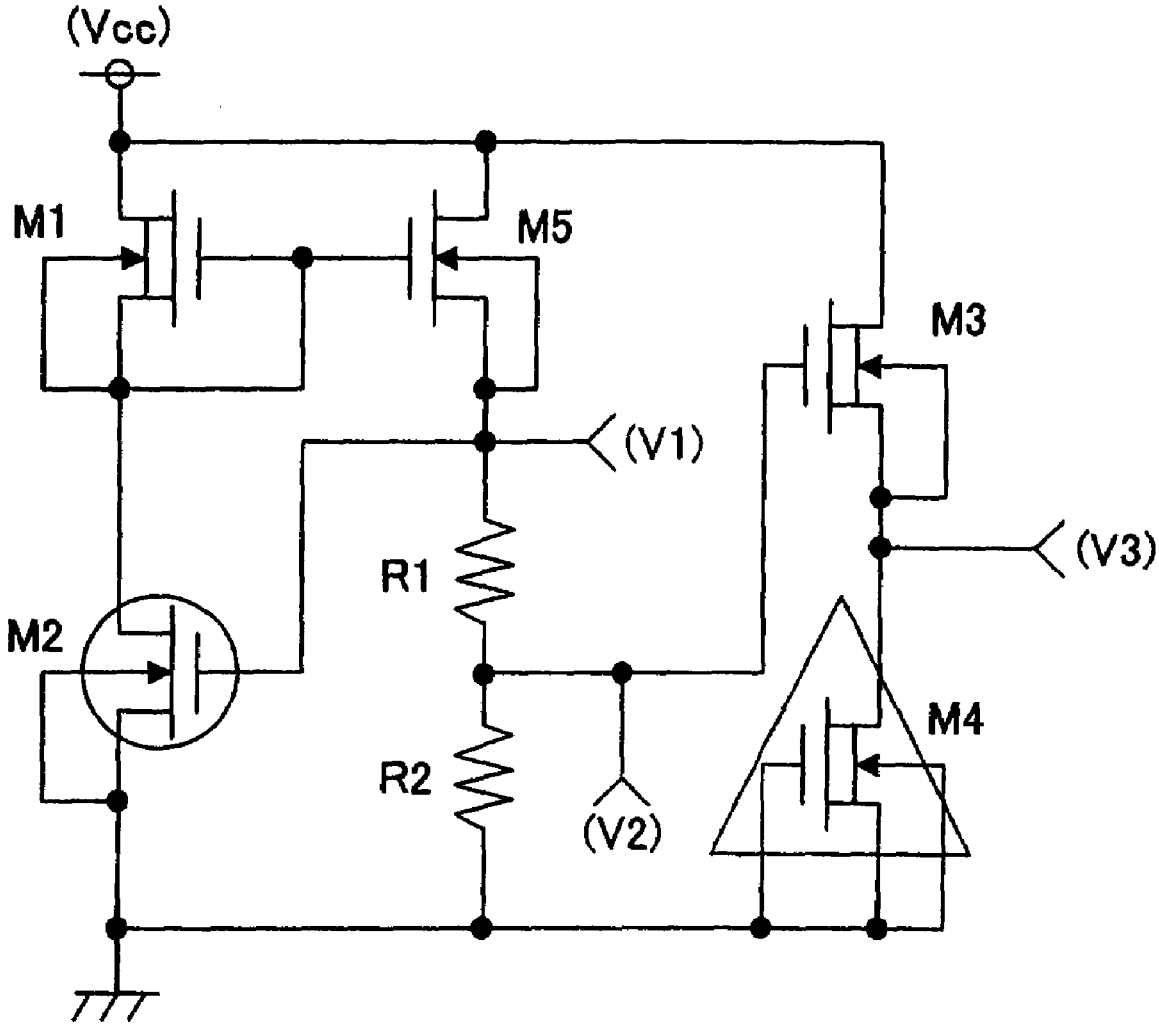
FIG. 10 is a circuit diagram showing an example of a conventional reference-voltage generating circuit.
Figure 11:
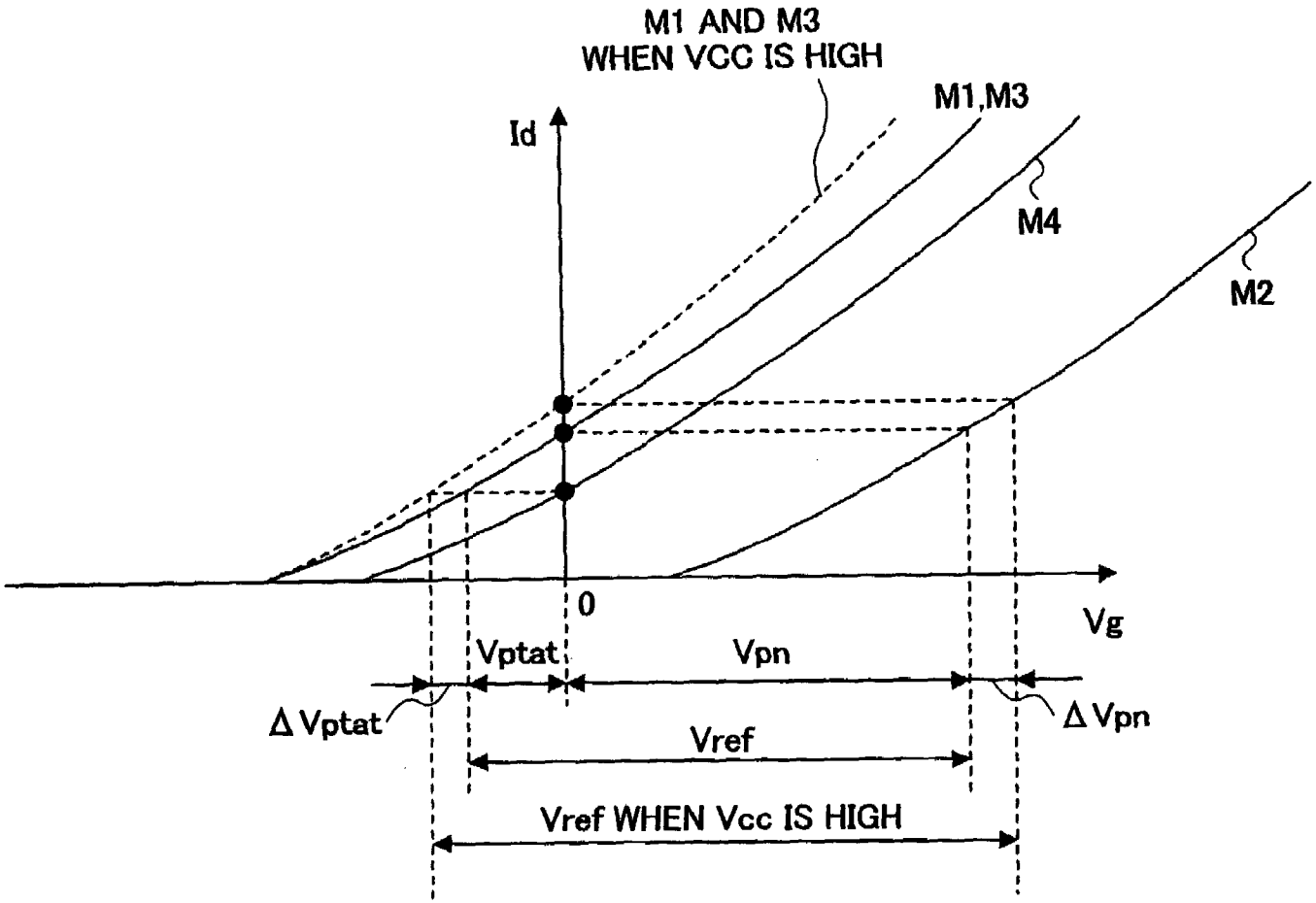
FIG. 11 is a graph showing an example of Vg-Id characteristics of n-type transistors M1 through M4 shown in FIG. 10.

FIG. 9 shows an example of the internal circuit of the reference-voltage generating circuit la that includes the supply voltage adjusting circuit 2*a* according to the second embodiment of the present invention. Here in FIG. 9, the same reference marks designate the same elements as FIG. 2, and explanations thereof are not repeated. Differences from the first embodiment are described. According to the example shown by FIG. 9, while the configuration and operations of the first voltage supply circuit 3 and the second voltage supply circuit 4 are the same as the first embodiment, the n-type transistor M7 is not used in the supply voltage adjusting circuit 2*a*.

Namely, as shown in FIG. 9, the voltage VA output from the n-type transistor M6 is provided to the drain of each of the n-type transistors M1, M3, and M5. It should also be noted that, in FIG. 9, the voltage VA is provided to the drain of the n-type transistor M5. (In the first embodiment, the drain of M5 is directly connected to Vcc.)

As shown in FIG. 9, the supply voltage adjusting circuit 2*a* includes the n-type transistor M6. The first voltage supply circuit 3 includes the n-type transistors M1, M2, and M5, and the resistors R1 and R2. The second voltage supply circuit 4 includes the n-type transistors M3 and M4.

Between the voltage VA and the ground potential, the n-type transistor M5, the resistor R1, and the resistor R2 are connected in series. The voltage V1 of the connecting point of the n-type transistor M5 and the resistor R1 is divided by the resistors R1 and R2, and the divided voltage serves as the voltage V2. Operations of the n-type transistor M6 of the supply voltage adjusting circuit 2*a*, the first voltage supply circuit 3, and the second voltage supply circuit 4 are the same as those of FIG. 2, and the explanations thereof are not repeated.

In this manner, the same effect as the first embodiment is obtained by the simplified circuit arrangement of the supply voltage adjusting circuit 2*a*.

Further, in the case of the first embodiment shown by FIG. 2, the supply voltage Vcc is input to the drain of the n-type transistor M5. For this reason, a rise of the supply voltage Vcc reduces the gate voltage of the n-type transistor M5. When the gate voltage of the n-type transistor M5 falls, the drain voltage of the n-type transistor M2 falls, and the voltage between the drain and the source of the n-type transistor M2 falls. For this reason, in the drain voltage-drain current characteristics of the n-type transistor M2, the operating point shifts from the saturation area to the linear (inclination) area, and the drain current of the n-type transistor M2 falls. If the drain current of the n-type transistor M2 falls, since the n-type transistor M1 serves as the constant current source, the gate voltage of the n-type transistor M2 is raised, and the voltage Vpn rises. In contrast, according to the reference-voltage generating circuit 1*a* of the second embodiment, the rise of the voltage Vpn accompanying the rise of such supply voltage Vcc is prevented from occurring.

Further, the present invention is not limited to these embodiments, but various variations and modifications may be made without departing from the scope of the present invention.

The present application is based on Japanese Priority Application No. 2003-301693 filed on Aug. 26, 2003, with the Japanese Patent Office, the entire contents of that are hereby incorporated by reference.

What is claimed is:

1. A method for generating and outputting a predetermined reference voltage, comprising:

generating and outputting at least one predetermined constant voltage by adjusting a supply voltage;

generating and outputting a first output voltage that has a negative temperature coefficient from said predetermined constant voltage;

generating a second output voltage that has a positive temperature coefficient from said predetermined constant voltage, and generating and outputting said reference voltage by adding said first output voltage and said second output voltage.

2. The method of claim 1, further comprising:

outputting a first predetermined constant voltage and a second predetermined constant voltage by adjusting the supply voltage; and generating said first output voltage and said second output voltage based on said first and second predetermined constant voltage.

3. The method of claim 2, further comprising:

generating and outputting a divided voltage that is proportional to said first output voltage; and generating said reference voltage by adding said second output voltage and said divided voltage.

4. A method for generating and outputting a predetermined reference voltage, comprising:

generating and outputting a first predetermined constant voltage and a second predetermined constant voltage by adjusting a supply voltage that is provided from an external source;

generating and outputting a first output voltage that has a negative temperature coefficient from said first predetermined constant voltage; and generating a second output voltage that has a positive temperature coefficient from said second predetermined constant voltage; and generating and outputting said reference voltage by adding said first output voltage and said second output voltage.

5. The method of claim 4, further comprising:

generating and outputting a divided voltage that is proportional to said first output voltage; and generating said reference voltage by adding said second output voltage and said divided voltage.

* * * * *